US009004318B2

(12) United States Patent
Kodama et al.

(10) Patent No.: US 9,004,318 B2
(45) Date of Patent: Apr. 14, 2015

(54) FOAM DISPENSING CONTAINER

(75) Inventors: Daisuke Kodama, Tokyo (JP); Shoii Uehira, Sagamihara (JP); Hiroya Morita, Sagamihara (JP); Daisuke Saito, Tokyo (JP)

(73) Assignee: Kao Corporation; Daiwa Can Company, Tokyo (JP)

( * ) Notice: Subject to any disclaimer, the term of this patent is extended or adjusted under 35 U.S.C. 154(b) by 0 days.

(21) Appl. No.: 13/700,522

(22) PCT Filed: May 31, 2011

(86) PCT No.: PCT/JP2011/062436

§ 371 (c)(1),
(2), (4) Date: Nov. 28, 2012

(87) PCT Pub. No.: WO2011/152375

PCT Pub. Date: Dec. 8, 2011

(65) Prior Publication Data

US 2013/0068794 A1 Mar. 21, 2013

(30) Foreign Application Priority Data

May 31, 2010 (JP) ..... 2010-124618
Jun. 15, 2010 (JP) ..... 2010-135823
Jun. 22, 2010 (JP) ..... 2010-141498

(51) Int. Cl.
*B05B 7/00* (2006.01)
*B65D 47/06* (2006.01)
*B05B 11/04* (2006.01)

(52) U.S. Cl.
CPC ..... *B65D 47/06* (2013.01); *B05B 7/0037* (2013.01); *B05B 11/047* (2013.01)

(58) Field of Classification Search
USPC ..... 222/190, 211, 145.5, 209, 189.1, 145.6; 239/327, 343
See application file for complete search history.

(56) References Cited

U.S. PATENT DOCUMENTS 3,572,590 A * 3/1971 Malone ..... 239/327
4,147,306 A 4/1979 Bennett (Continued)

FOREIGN PATENT DOCUMENTS

JP 60-78747 6/1985
JP 1-122851 8/1989

(Continued)

OTHER PUBLICATIONS

Patent Abstracts of Japan, Publication No. JP H07-215353 (corresponds to JP 2934145), 16 pages.

(Continued)

*Primary Examiner* — Kevin P Shaver
*Assistant Examiner* — Robert Nichols, II
(74) *Attorney, Agent, or Firm* — Rankin, Hill & Clark LLP

(57) ABSTRACT

It is an object of the present invention to provide a foam dispensing container that can homogenize foam quality and can discharge foam of stable quality. By providing a plurality of liquid intake paths for delivering the foaming liquid into the air-liquid mixing chamber and a plurality of air intake paths for delivering air, the air-liquid mixing efficiency can be improved significantly, stable volumes of air and foaming liquid can be delivered into the air-liquid mixing chamber, without the possibility of delivering a great volume of liquid with a single press, and consequently the foam quality can be homogenized and foam of stable quality can be discharged.

13 Claims, 9 Drawing Sheets

(56) References Cited

U.S. PATENT DOCUMENTS

| | | | | |
|---|---|---|---|---|
| 4,509,661 | A * | 4/1985 | Sugizaki et al. | 222/190 |
| 5,033,654 | A * | 7/1991 | Bennett | 222/190 |
| 5,048,750 | A * | 9/1991 | Tobler | 222/190 |
| 5,219,102 | A * | 6/1993 | Wright | 222/190 |
| 5,259,715 | A * | 11/1993 | Harle | 411/311 |
| 5,275,338 | A * | 1/1994 | Tobler | 239/327 |
| 5,409,136 | A * | 4/1995 | Workum | 222/1 |
| 5,467,898 | A * | 11/1995 | Hori | 222/190 |
| 6,868,990 | B2 | 3/2005 | Cater et al. | |
| 8,430,107 | B2 * | 4/2013 | Huang | 132/113 |
| 2010/0126523 | A1 * | 5/2010 | Fujinuma et al. | 132/221 |
| 2011/0284587 | A1 * | 11/2011 | Galazka et al. | 222/190 |
| 2014/0209639 | A1 * | 7/2014 | Sasaki et al. | 222/190 |

FOREIGN PATENT DOCUMENTS

| | | |
|---|---|---|
| JP | 4-25240 | 6/1992 |
| JP | 2934145 | 8/1999 |
| JP | 2006-290365 | 10/2006 |

OTHER PUBLICATIONS

Patent Abstracts of Japan, Publication No. JP 2006-290365, 14 pages.
Partial English Description of JP 60-78747, 1 page.
Partial English Description of JP 1-122851, 5 pages.
Notification of Transmittal of Translation of the International Preliminary Report on Patentability, Translation of the Written Opinion, 9 pages.
International Search Report dated Sep. 6, 2011, 4 pages.

* cited by examiner (a)

(b)

(A)

(B)

FOAM DISPENSING CONTAINER

RELATED APPLICATIONS

The present application claims the benefits of priority from Japanese Patent Application No. 2010-124618, filed on May 31, 2010, Japanese Patent Application No. 2010-135823, filed on Jun. 15, 2010, and Japanese Patent Application No. 2010-141498, filed on Jun. 22, 2010, the contents of which are hereby incorporated by reference into this application.

FIELD OF THE INVENTION

The present invention relates to foam dispensing containers for discharging, from an opening, foam produced by mixing a foaming liquid contained in a container body and air when the container body is pressed from the outside, and more specifically, to an improvement of the stability of the foam quality.

BACKGROUND OF THE INVENTION

Conventionally known foam dispensing containers discharge foam produced from a foaming liquid contained in the container body when the trunk portion of the container, which is elastic, is pressed by a human hand. In these types of foam dispensing containers, to produce foam, the foaming liquid and air must be mixed in a mixing chamber provided in a lid body. Widely used foam dispensing containers have an air opening for delivering air into the lid body from the container body and mix the foaming liquid with the delivered air to produce foam.

In a foam dispensing container disclosed in Japanese Patent No. 2934145, for example, the foam quality can be improved by delivering air into the air-liquid mixing chamber from a plurality of positions in the circumferential direction rather than from one position. In the foam dispensing container, however, since the foaming liquid is delivered from one position in the lower part of the air-liquid mixing chamber, the area of contact between the foaming liquid and air is so small that adequate mixing of the two is sometimes hindered, and foam of good quality cannot always be provided. When the container is pressed, a large amount of foaming liquid sometimes flows into the air-liquid mixing chamber at once, causing the foaming liquid to be discharged before it is sufficiently mixed with air. The uniformity and stability in foam quality have not been satisfactory. Although the foam quality has been adjusted by changing the amount of foaming liquid delivered into the air-liquid mixing chamber by changing the cross-sectional area of the flow path in the tube body, the change in the cross-sectional area of the flow path in the tube body changes the flow speed of the liquid supplied into the air-liquid mixing chamber, affecting the air-liquid mixing conditions in the air-liquid mixing chamber. The process of trial and error to find the cross-sectional area of the flow path in the tube body that provides foam of desired quality requires great effort, making it difficult to adjust the foam quality sometimes. Although a reduced cross-sectional area of the flow path in the foaming liquid inlet is expected to improve the air mixing efficiency, consequently homogenizing the foam, the foam dispensing container disclosed in Japanese Patent No. 2934145 has just a single liquid inlet and requires a greater pressing force to discharge foam, lowering the usability of the container.

In a foam dispensing container disclosed in Japanese Utility Model Publication No. H1-122851, for example, the air intake path into the air-liquid mixing chamber is formed by a gap between a pipe fixture (flow path forming portion) disposed in a pipe joint and the inner wall of a lid member. In the foam dispensing container having this type of structure, the size of the gap changes depending on how the pipe joint and the lid member are assembled, changing the cross-sectional area of the air intake flow path and causing the amount of air flowing into the mixing chamber to exceed or fall below the designed level, which prevents foam of a desired foam quality from being formed. For example, when the pipe fixture is insufficiently fitted into the lid member, the gap between them increases, increasing the cross-sectional area of the air intake flow path. This would allow a greater-than-designed amount of air to flow, lowering the foam density and making it impossible to obtain foam of desired quality. Depending on how the produced components are assembled and how the components fit together, different containers have different gaps between the pipe fixture and the inner wall of the lid member, producing variations in the cross-sectional area of the air intake flow path and in the flow of air into the mixing chamber. The foam dispensing containers having the conventional structure, represented by the one disclosed in Japanese Utility Model Publication No. H1-122851, cannot provide foam of stable quality because of the variations in the quality of discharged foam among individual containers. While the containers are being used repeatedly, the pressure applied to the components or the force exerted on the containers from the outside affects the fitting status of the components, changing the cross-sectional area of the air intake flow path and making the foam quality unstable over time.

CITATION LIST

Patent Literature

Patent literature 1: Japanese Patent No. 2934145

Patent literature 2: Japanese Utility Model Publication No. H1-122851

DISCLOSURE OF THE INVENTION

Problem to be Solved by the Invention

In view of the conventional arts described above, the present invention has been made. It is an object of the present invention to provide a foam dispensing container that can homogenize foam quality and can discharge foam of stable quality.

Means to Solve the Problem

As a result of earnest study in view of the problems in the conventional arts, the inventors et al. have found the following and completed the present invention: By providing a plurality of liquid intake paths for delivering the foaming liquid into the air-liquid mixing chamber and a plurality of air intake paths for delivering air, the air-liquid mixing efficiency can be improved significantly, stable volumes of air and foaming liquid can be delivered into the air-liquid mixing chamber, without the possibility of delivering a great volume of liquid with a single press, and consequently the foam quality can be homogenized and foam of stable quality can be discharged.

A foam dispensing container according to the present invention includes a container body made of a material possessing elasticity, a lid body mounted to a mouth of the container body, and a tube body connecting the inside of a trunk portion of the container body and the inside of the lid body. In the foam dispensing container, when the container body is pressed from the outside, a foaming liquid contained in the trunk portion of the container body and air in an upper space in the container body are mixed to produce foam in an air-liquid mixing chamber provided in the lid body, and the foam is discharged from an opening of the lid body. The lid body includes a plurality of liquid intake paths that are connected through the tube body to the inside of the trunk portion of the container body and deliver the foaming liquid into the air-liquid mixing chamber, a plurality of air intake paths that are connected to the upper space in the container body and deliver air into the air-liquid mixing chamber, an outside-air intake that closes to seal the container body when the container body is pressed and opens to connect the inside of the container body to the outside and to allow air to enter from the outside when the pressure of the container body is reduced, the air-liquid mixing chamber, which is connected to the plurality of liquid intake paths and the plurality of air intake paths and in which the foaming liquid and air are mixed to produce foam, a foam discharge passage connected to the downstream side of the air-liquid mixing chamber, and a foam discharge opening that is provided at the downstream end of the foam discharge passage and that discharges foam to the outside.

In the foam dispensing container, it is preferable that the plurality of liquid intake paths and the plurality of air intake paths join in a plurality of air-liquid confluence portions, and the plurality of air-liquid confluence portions be connected to the air-liquid mixing chamber through a plurality of air-liquid connection openings.

In the foam dispensing container, it is preferable that the lid body include an inside plug connected to the tube body and a mixing device fitted into the inside plug, the plurality of air intake paths, the plurality of liquid intake paths, and the plurality of air-liquid confluence portions be formed between the inside plug and the mixing device, and the plurality of air-liquid connection openings be formed in the mixing device.

In the foam dispensing container, it is preferable that the air intake paths be formed by grooves provided in the inner wall of the inside plug.

In the foam dispensing container, it is preferable that the liquid intake paths be formed by grooves provided in the inner wall of the inside plug.

In the foam dispensing container, it is preferable that the tube body be fitted into an end of the inside plug.

In the foam dispensing container, it is preferable that the liquid intake paths include at least an enlarged flow path portion that is connected to the tube body and has a greater cross-sectional area than the tube body and a branch flow path portion that is connected to the enlarged flow path portion and that branches into a plurality of flow paths, each of the flow paths being connected to the air-liquid mixing chamber, that the cross-sectional area of a single flow path in the branch flow path portion be smaller than the cross-sectional area of the flow path in the tube body, and that the total cross-sectional area of the plurality of flow paths in the branch flow path portions be greater than the cross-sectional area of the flow path in the tube body.

In the foam dispensing container, it is preferable that the cross-sectional area of at least a part of the enlarged flow path portion be greater than the total cross-sectional area of the plurality of flow paths in the branch flow path portion.

In the foam dispensing container, it is preferable that the cross-sectional area of at least a part of the enlarged flow path portion be 1.5 times or more and 3 times or less the total cross-sectional area of the plurality of flow paths in the branch flow path portion.

In the foam dispensing container, it is preferable that the plurality of air intake paths and the plurality of liquid intake paths be disposed alternately at regular intervals in the circumferential direction of the air-liquid mixing chamber.

In the foam dispensing container, it is preferable that the air intake paths be formed by gaps left among a plurality of members forming the lid body when the members are fitted together and include at least a flow path portion provided in the direction in which the plurality of members are fitted together, and that the cross-sectional area of the flow path portion in the fitting direction in the air intake paths be smaller than the cross-sectional area of any flow path portion in other directions.

In the foam dispensing container, it is preferable that the fitting direction of the plurality of members be almost vertical when the container body is held in the upright position and that the flow path portion in the fitting direction be a vertical flow path portion provided almost vertically when the container body is held in the upright position.

In the foam dispensing container, it is preferable that the air intake paths include the vertical flow path portion and a downstream horizontal flow path portion that is connected to the downstream side of the vertical flow path portion and provided almost horizontally when the container body is held in the upright position, and that the ratio of the cross-sectional area Sp2 of the vertical flow path portion to the cross-sectional area Sp3 of the downstream horizontal flow path portion satisfy $0.6 \leq Sp2/Sp3 \leq 1.0$.

Effect of the Invention

With a plurality of liquid intake paths for delivering the foaming liquid into the air-liquid mixing chamber and a plurality of air intake paths for delivering air thereto, the foam dispensing container according to the present invention provides a significantly improved air-liquid mixing efficiency, does not allow a great amount of liquid to flow into the air-liquid mixing chamber with a single press, and can deliver stable amounts of air and foaming liquid, so that the foam quality can be homogenized, and foam of stable quality can be discharged.

In the foam dispensing container according to the present invention, the liquid intake paths include an enlarged flow path portion having a greater cross-sectional area than the tube body and a branch flow path portion that branches into a plurality of branch flow paths each connected to the air-liquid mixing chamber, the cross-sectional area of a single flow path of the branch flow path portion is smaller than the cross-sectional area of the flow path in the tube body, and the total cross-sectional area of the plurality of flow paths is larger than the cross-sectional area of the flow path in the tube body, so that a large amount of foaming liquid will not flow into the air-liquid mixing chamber with a single press, and a stable amount of liquid can be delivered to the air-liquid mixing chamber. Therefore, the foam quality can be homogenized, and foam of stable quality can be discharged.

In the foam dispensing container according to the present invention, the air intake paths include a flow path portion extending in the same direction as the direction in which members forming the lid body are fitted together, and the cross-sectional area of the flow path portion in the fitting direction is smaller than the cross-sectional area of the flow path portions in other directions. Therefore, how the components are assembled and the fitting status among the components will not affect the cross-sectional area of the flow path portion in the fitting direction, and a constant amount of air is delivered into the air-liquid mixing chamber. The foam quality will not vary among individual containers, and foam of stable quality can be discharged over a long time even when the container is repeatedly used or the fitting status of the components changes due to an impact from the outside or the like.

DESCRIPTION OF REFERENCE NUMBERS

Figure 1:
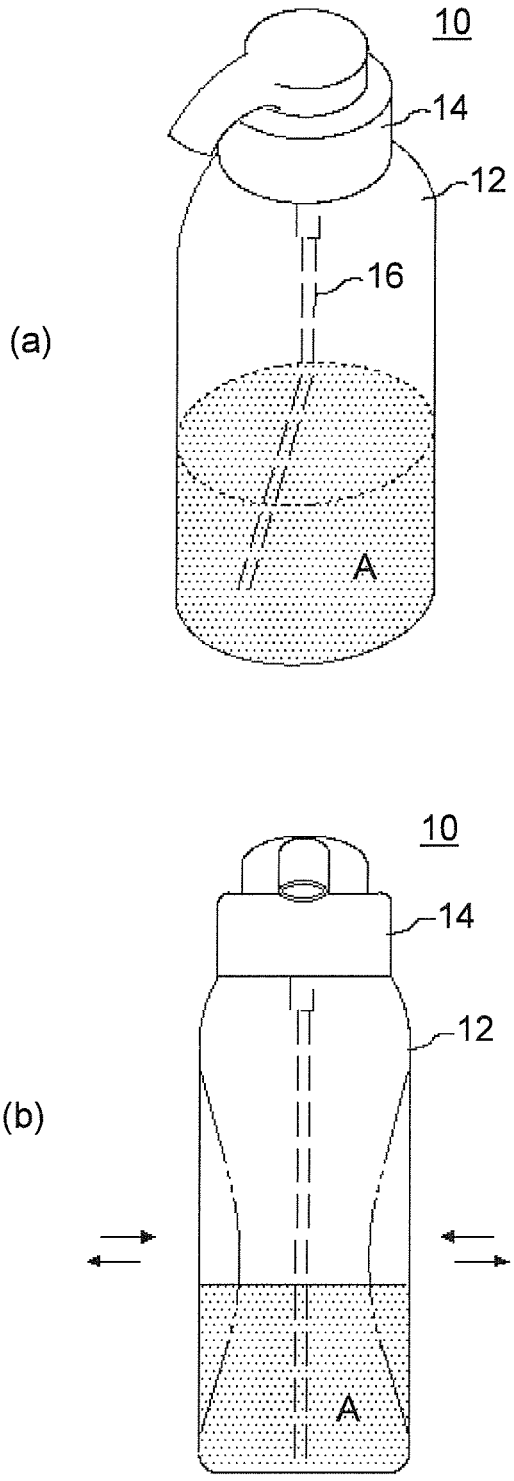
FIG. 1 shows a perspective view (a) and an elevational view (b) of a foam dispensing container according to an embodiment of the present invention.

10: Foam dispensing container
12: Container body
14: Lid body
16: Tube body
20: Inside plug
22: Mixing device
24: Base cap
26: Apex nozzle
28: First mesh
30: Second mesh
32: Ball valve

BEST MODE FOR CARRYING OUT THE INVENTION

Preferred embodiments of the present invention will be described with reference to the drawings, but the present invention is not limited to those embodiments.

First Embodiment

FIG. 1 shows a perspective view (a) and an elevational view (b) of a foam dispensing container 10 according to an embodiment of the present invention.

As shown in FIG. 1, the foam dispensing container 10 in this embodiment includes a container body 12 for containing a foaming liquid A, a lid body 14 that is detachably disposed on a mouth at the upper end of the container body 12, and a tube body 16 that is connected to the lid body 14 and extends toward the inside of the container body 12. When the foam dispensing container 10 is held in the upright position, the trunk portion of the container body 12 is pressed from the outside and is deformed in the directions indicated by the arrows in FIG. 1(*b*). This causes the foaming liquid A contained in the trunk portion of the container body 12 and air in the upper space of the container body 12 to be mixed in the lid body 14 to produce foam, and the foam is discharged from an opening in the lid body 14.

The container body 12 is made of materials (usually plastic materials) possessing elasticity and allow deformation by applying pressure. For example, materials with so-called squeezing properties, that is, good pressing properties and squeeze-back (restoring) properties, such as polyolefin-based resins including polypropylene (PP), high-density polyethylene (HDPE), medium-density polyethylene (MDPE), and low-density polyethylene (LDPE), and polyester-based resins including polyethylene terephthalate (PET), can be used singly or in combination.

Figure 2:
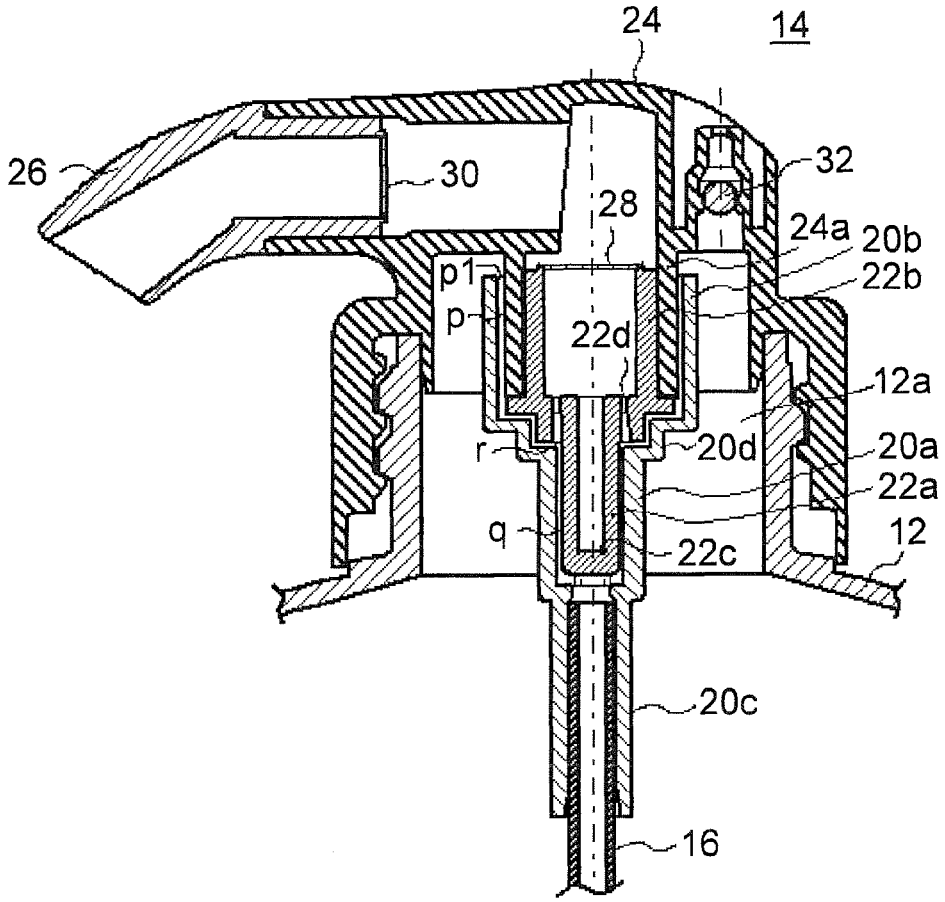
FIG. 2 is an enlarged cross-sectional view of a lid body of the foam dispensing container according to a first embodiment of the present invention.

FIG. 2 shows an enlarged cross-sectional view of the lid body 14 of the foam dispensing container 10 in the first embodiment of the present invention.

As shown in FIG. 2, the lid body 14 detachably covers the mouth of the container body 12 by screwing it thereon. The lid body 14 has an inside plug 20 in a base cap 24 and a mixing device 22 inserted into the inside plug 20. In lower parts 20*a* and 22*a* of the inside plug 20 and the mixing device 22, the inner wall of the inside plug 20 and the outer wall of the mixing device 22 face each other directly. In upper parts 20*b* and 22*b*, however, the inner wall of the inside plug 20 and the outer wall of the mixing device 22 face each other with a tubular wall 24*a* suspended from the base cap 24 placed between them.

The tube body 16 is inserted into an end 20*c* of the inside plug 20, connecting the interior of the inside plug 20 to the inserted tube body 16. The tube body 16 is dog-legged so that the liquid in the container body 12 can be fully discharged when the foam dispensing container 10 is inclined to the discharge opening side of an apex nozzle 26, and the opening at the end of the tube body 16 is directed toward the discharge opening side of the apex nozzle 26 at the bottom of the container body 12.

The mixing device 22 has a closed-bottom tubular shape and a bottom 22*c* thereof is directed toward the tube body 16. The mixing device 22 has a first mesh 28 at an opening end opposite the tube body 16 and is connected, through the base cap 24, to the discharge opening of the apex nozzle 26. A second mesh 30 is further disposed between the base cap 24 and the apex nozzle 26.

Formed between the inside plug 20 and the mixing device 22 are a plurality of air intake paths p, a plurality of liquid intake paths q, and air-liquid confluence portions r, where the air intake paths p and the liquid intake paths q meet. Each air intake path p connects the air-liquid confluence portion r and the upper space 12*a* in the container body 12, and each liquid intake path q connects the air-liquid confluence portion r and the tube body 16. The air-liquid confluence portions r are connected to the inside of the mixing device 22 through a plurality of connection openings 22*d* formed in the mixing device 22.

Figure 3:
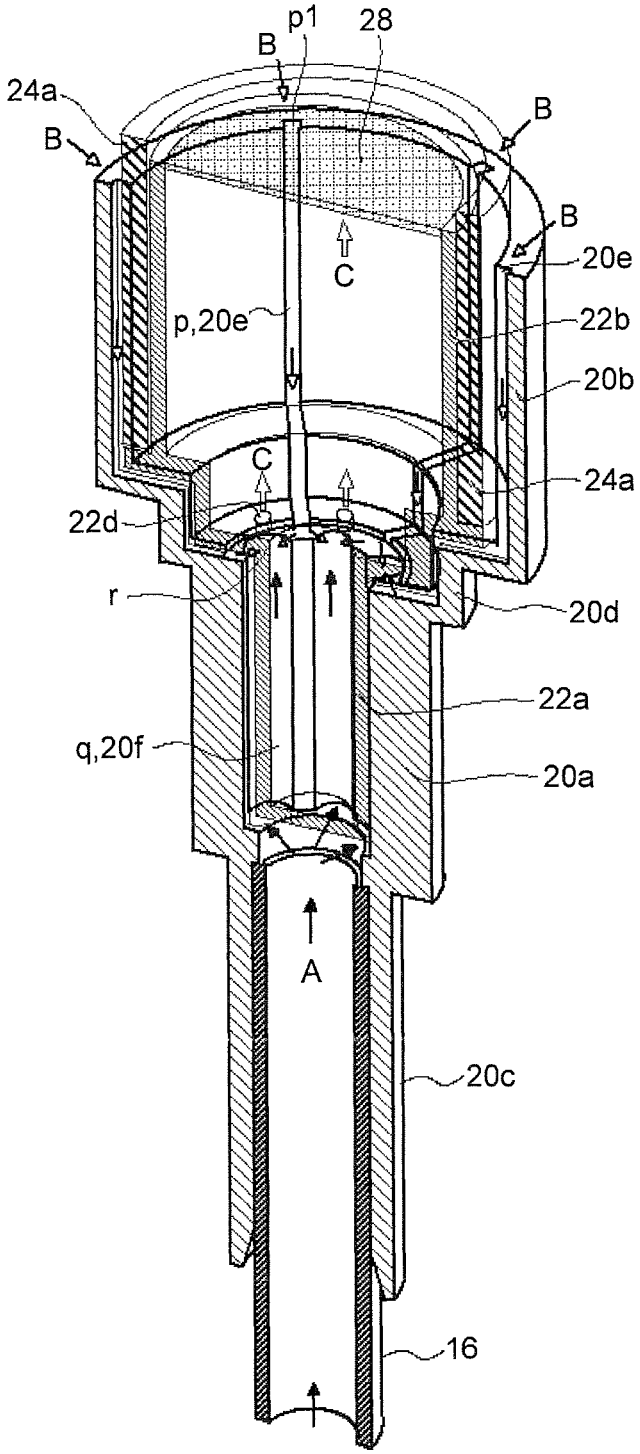
FIG. 3 illustrates the flow of air and a liquid in the vicinity of an air-liquid confluence portion (inside plug and mixing device) in the lid body of the foam dispensing container according to the first embodiment of the present invention.
Figure 4:
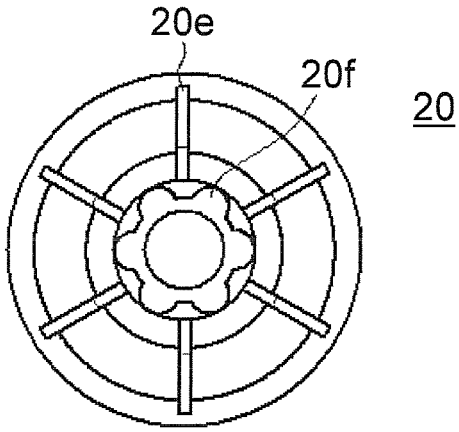
FIG. 4 shows a plan view (a) and a perspective view (b) of the inside plug of the foam dispensing container according to the first embodiment of the present invention.
Figure 4:
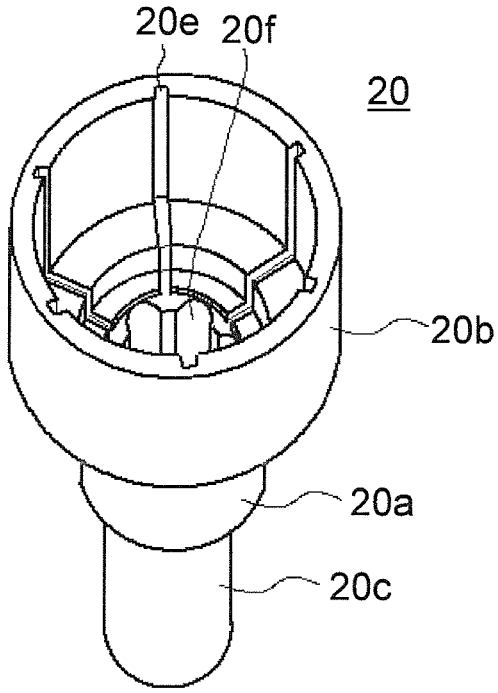

FIG. 3 illustrates the flow of air and a liquid in the vicinity of the air-liquid confluence portion (inside plug 20 and mixing device 22) in the lid body 14 in this embodiment. FIG. 4 shows a plan view (a) and a perspective view (b) of the inside plug 20 in this embodiment.

As shown in FIGS. 3 and 4, six vertical grooves 20*e* running from the upper edge of the inside plug 20 to the air-liquid confluence portion r in the middle are formed in the inner wall of the upper part 20*b*, that is, almost the upper half of the inside plug 20. When the tubular wall 24*a* is inserted between the inside plug 20 and the mixing device 22, a plurality of air intake paths p are formed in the gaps between the inner wall of the upper part 20*b* of the inside plug 20 and the tubular wall 24*a* and in the gaps between the inner wall of a step portion 20*d* of the inside plug 20 and the mixing device 22. Here, as shown in FIG. 2, air intakes p1 of the air intake paths p are formed on the upper edge of the inside plug 20, that is, immediately below the base cap 24 in the vicinity of the apex nozzle 26, at positions farthest from the surface of the foaming liquid in the container body 12. This prevents the air intakes p1 from being blocked by foam if the foaming liquid foams in the container body 12, and makes it possible to discharge foam of good quality.

Six vertical grooves 20*f* running from a position above the insertion end of the tube body 16 to the air-liquid confluence portions r in the middle of the inside plug 20 are formed on the surface of the inside plug 20 facing the mixing device 22 in the lower part 20*a*, that is, almost the lower half of the inside plug 20, so that a plurality of liquid intake paths q are formed in the gaps between the inside plug 20 and the mixing device 22. By providing the plurality of air intake paths p and the plurality of liquid intake paths q and mixing air and liquid in the plurality of air-liquid confluence portions r, the air-liquid mixing efficiency can be improved, and the foam quality can be homogenized. In this embodiment, the horizontal cross-sectional shapes of the air liquid intake paths p are rectangular, and the horizontal cross-sectional shapes of the liquid intake paths q are semicircular, but the horizontal cross-sectional shapes are not confined to these shapes, and the air intake paths p and the liquid intake paths q may have the same horizontal cross-sectional shape.

The foam dispensing container 10 in this embodiment has six air intake paths p and six liquid intake paths q. In the present invention, the number of intake paths is determined appropriately in accordance with the desired foam quality, and it is usually preferred to provide 2 to 36 air intake paths p and 2 to 36 liquid intake paths q.

Although the liquid intake paths q in the foam dispensing container 10 are formed by the grooves 20*f* in the inner wall of the lower part 20*a* of the inside plug 20 in this embodiment, they may also be formed by grooves disposed in the outer wall of the lower part 22*a* of the mixing device 22 facing the inner wall of the lower part 20*a* of the inside plug 20. Likewise, the air intake paths p may be formed by providing grooves in the tubular wall 24*a* facing the inside plug 20 or the outer wall of the mixing device 22.

Figure 5:
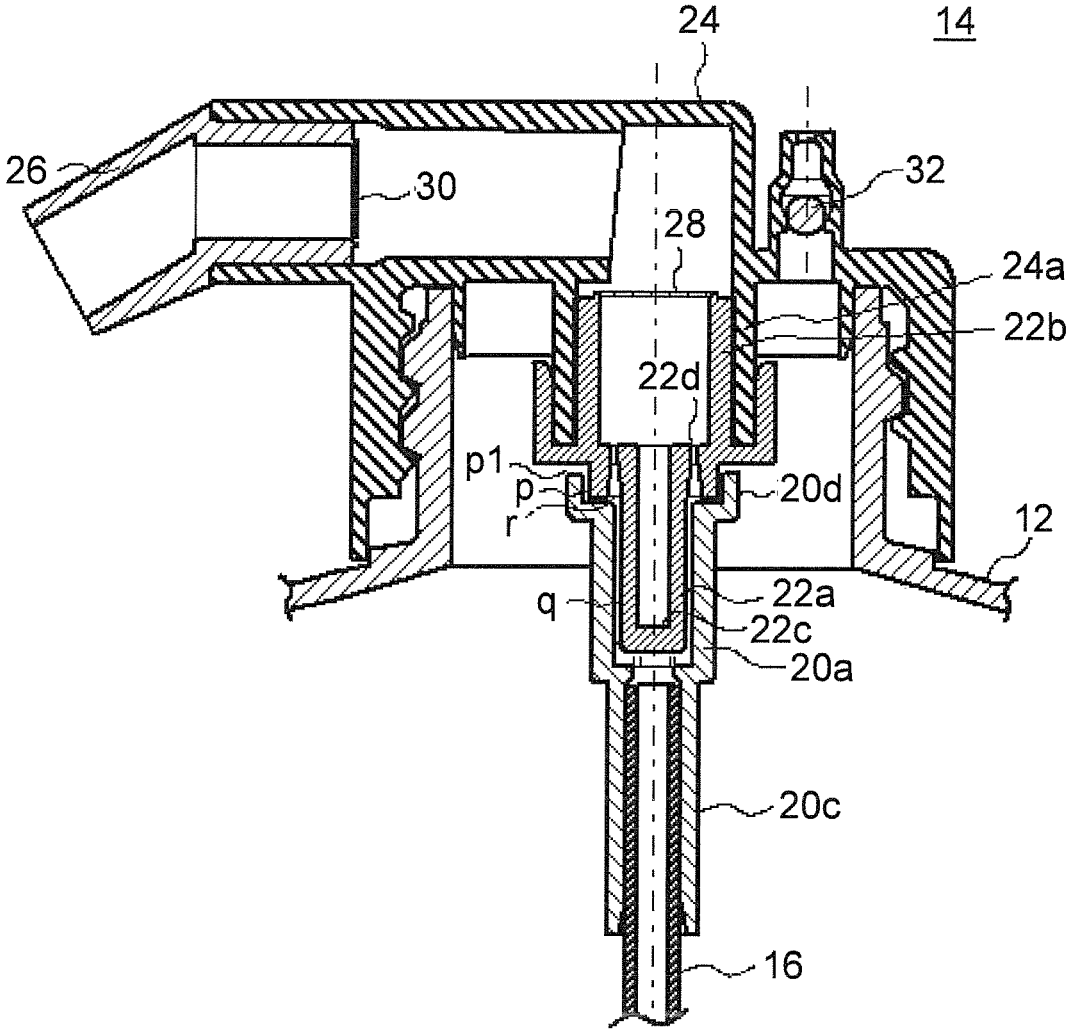
FIG. 5 shows a modified example of the lid body of the foam dispensing container according to the first embodiment of the present invention.

FIG. 5 shows a modified example of the lid body 14 in this embodiment.

Since the fitting force of the inside plug 20 and the mixing device 22 can be improved by inserting the tubular wall 24*a* between them, as in the lid body 14 shown in FIG. 2, the tube body 16 or the lid body 14 can be prevented from being turned even if a force that can turn the opening at the end of the tube body 16 is exerted while the foam dispensing container 10 is being transported. This is also preferable because it allows the air intakes p1 of the air intake paths p to be kept far away from the surface of the liquid A. As shown in FIG. 5, the inside plug 20 and the mixing device 22 may face each other directly without the tubular wall 24*a* being inserted between the inside plug 20 and the mixing device 22, and the mixing device 22 and the inside plug 20 that is fitted in the mixing device 22 may be fixed in the base cap 24 by fitting the mixing device 22 and the tubular wall 24*a*. In that case, the air intake paths p and the liquid intake paths q may be formed by providing grooves in either of the facing surfaces of the inside plug 20 and the mixing device 22. This can increase the degree of freedom in designing the air-liquid mixing ratio.

The base cap 24 has a ball valve 34 acting as a check valve that blocks the outflow of air from the inside of the base cap 24 to the outside and allows the inflow of air from the outside to the inside of the base cap 24.

The foam dispensing container 10 in this embodiment is used as described below.

With the foaming liquid contained in the container body 12, the user presses the trunk portion of the container body 12. This increases the internal pressure in the container body 12, causing the liquid A to enter the tube body 16, branch off into the plurality of liquid intake paths q, and reach the plurality of air-liquid confluence portions r, as shown in FIG. 3. In the meantime, air B is delivered via the plurality of air intake paths p connected to the upper space 12*a* of the container body 12 to the plurality of air-liquid confluence portions r. The liquid A and air B are mixed homogeneously in the plurality of air-liquid confluence portions r, and a mixture C flows through the plurality of connection openings 22*d* into the mixing device 22. Foam formed in the mixing device 22 passes through the first mesh 28 and then the second mesh 30, where the foam quality is improved, and is discharged from the discharge opening of the apex nozzle 26 (foam discharge passage). When the pressing force on the container body 12 is released, the container body 12 returns to its original shape by virtue of its elasticity, and the internal pressure decreases. The reduced internal pressure in the container body 12 causes the ball of the ball valve 32 to fall down to its lock position under its own weight, opening the ball valve 32, from which the outside air enters the container body 12 and returns the container body 12 to normal pressure. By repeating the pressing and releasing, the foaming liquid in the container body 12 can be discharged in the form of foam.

Second Embodiment

Figure 6:
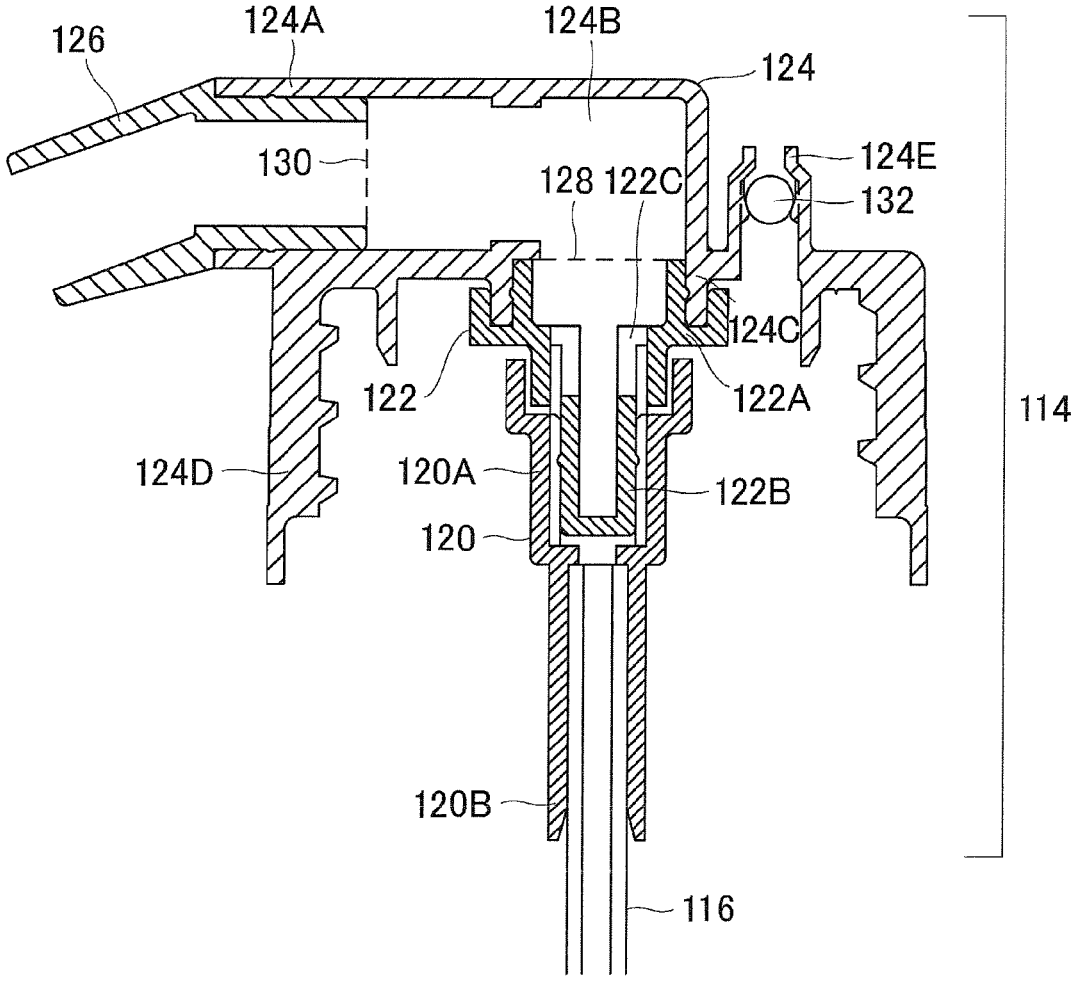
FIG. 6 shows an enlarged cross-sectional view of a lid body of a foam dispensing container according to a second embodiment (and a third embodiment) of the present invention.

FIG. 6 shows an enlarged cross-sectional view of a lid body 114 of a foam dispensing container 110 according to a second embodiment of the present invention.

The lid body 114 in this embodiment includes an inside plug 120 into which a tube body 116 is fitted, a mixing device 122 that fits into the inside plug 120, a base cap 124 into which the mixing device 122 is fitted, an apex nozzle 126 that fits into the base cap 124, a first mesh 128 that is disposed between the base cap 124 and the mixing device 122, a second mesh 130 that is disposed between the base cap 124 and the apex nozzle 126, and a ball valve 132, and these components are integrally assembled. These components are usually made of plastic materials. In this embodiment, for example, the base cap 124 and the inside plug 120 are made of polypropylene (PP), and the mixing device 122 is made of high-density polyethylene (HDPE).

The tube body 116 is fitted into a lower tubular portion 120B of the inside plug 120 from below. An upper tubular portion 120A of the inside plug 120 has two tubular stages with different inside diameters, and the mixing device 122 is fitted into the upper tubular portion 120A from above, leaving specified gaps.

The mixing device 122 includes a connection opening 122C in a step portion between a lower tubular portion 122B and an upper tubular portion 122A. The mixing device 122 fits into the inside plug 120 with the specified gaps left between them so that the foaming liquid in the container body 112 and air in the upper space of the container body 112 can be delivered through connection openings 122C into the mixing device 122. The foaming liquid is delivered from the container body 112, through the tube body 116, the inside plug 120, the gaps, and the connection openings 122C into the mixing device 122 (liquid intake paths). The gaps open toward the upper space in the container body 112, and air in the upper space is delivered through the gaps and the connection openings 122C into the mixing device 122 (air intake paths). When the container body 112 is pressed from the outside, the foaming liquid and air pressed out of the container body 112 are delivered through the connection openings 122C to the inside of the mixing device 122, where the two are mixed to produce foam. In this embodiment, six connection openings 122C are formed in the cylindrical cross-section of the step portion of the mixing device 122 at regular intervals in the circumferential direction. The air intake paths connected to the connection openings 122C are formed by six gaps provided at regular intervals in the circumferential direction, and the liquid intake paths are formed by six gaps provided in the cylindrical cross-section of the upper tubular portion 120A of the inside plug 120 and the lower tubular portion 122B of the mixing device 122 at regular intervals in the circumferential direction. The upper tubular portion 122A of the mixing device 122 has a double tube structure into which the tubular wall 1240 of the base cap 124 fits.

The base cap 124 has a screw portion 124D in its lower part, and with the screw portion 124D screwed onto the mouth portion of the container body 112, the lid body 114 is detachably mounted on the container body 112. The apex nozzle 126 equipped with the second mesh 130 is fitted into an end tubular portion 124A of the base cap 124. The foaming liquid and air are mixed to produce foam in the air-liquid mixing chamber formed in the mixing device 122, and the foam is homogenized when it is pressed through the first mesh 128 into a housing 124B of the base cap 124. Foam that gets through the housing 124B is pressed through the second mesh 130 towards the apex nozzle 126 and is discharged from the opening (foam discharge passage).

The base cap 124 includes an outside-air intake 124E of a designated size that communicates with the upper space in the container body 112 and a ball valve 132 sealed in the vicinity of the outside-air intake 124E. When the container body 112 is pressed, the ball valve 132 is pressed toward the outside-air intake 124E to seal the container body 112; when the container body 112 is released, the ball valve 132 moves and allows the outside-air intake 124E to open, and the container body 112 is connected to the outside. The ball valve 132 is used to seal or unseal the outside-air intake 124E in this embodiment, but a different valve structure, such as a plate valve, may also be used.

Figure 7:
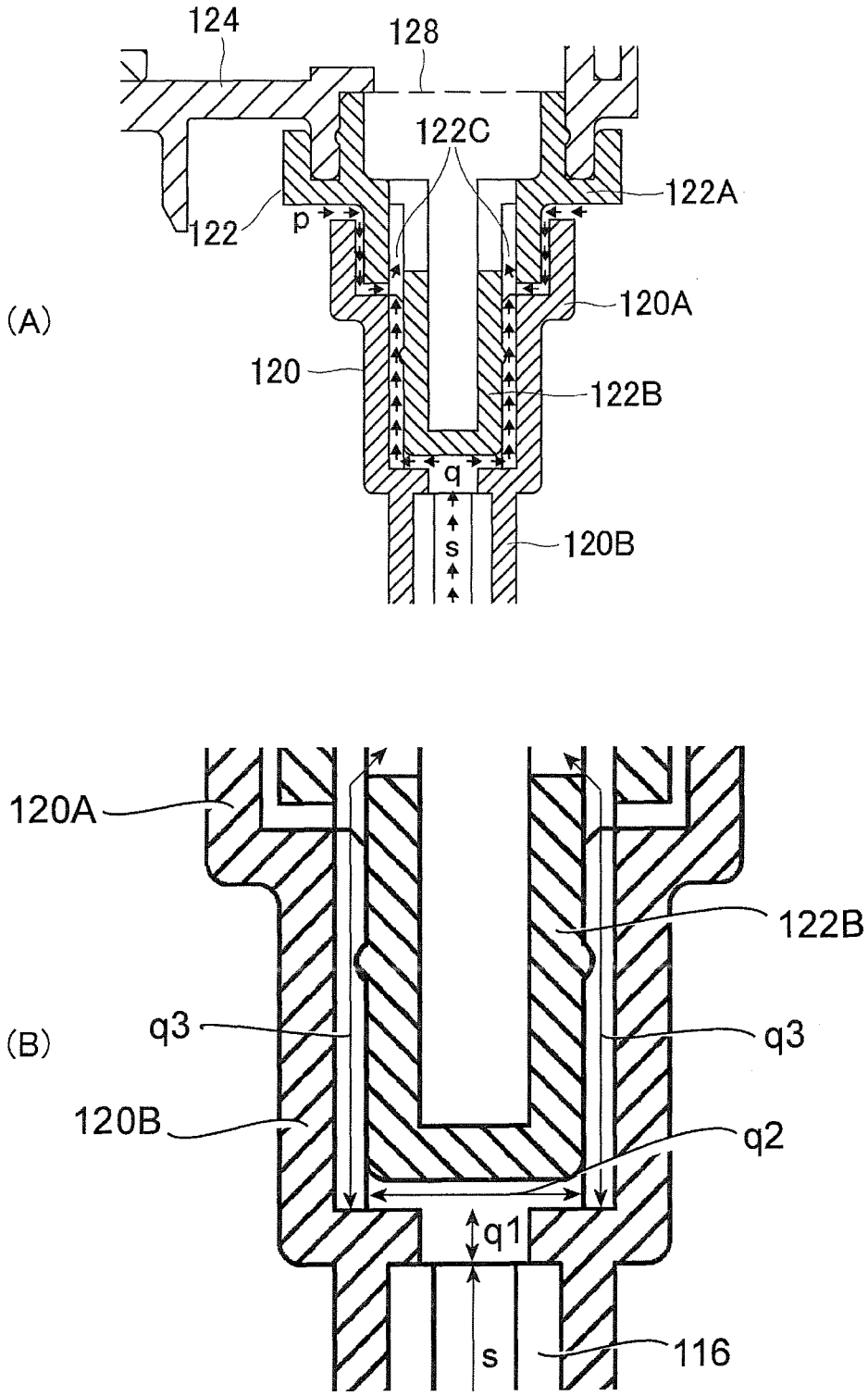
FIG. 7 shows enlarged principal cross-sectional views of the lid body of the foam dispensing container according to the second embodiment of the present invention.

The liquid intake paths and the air intake paths in this embodiment will be explained in more detail with reference to enlarged principal cross-sectional views of the lid body 114 shown in FIG. 7.

In the lid body 114 in this embodiment, as shown in FIG. 7(A), the liquid intake paths q for delivering the foaming liquid from the container body 112 into the mixing device 122 and the air intake paths p for delivering air from the upper space in the container body 112 to the mixing device 122 are formed in the gaps between the mixing device 122 and the inside plug 120. The liquid intake paths q and the air intake paths p join in vicinities of the upstream portions of the connection openings 122C of the mixing device 122, and both paths are connected to the mixing device 122 through the same connection openings 122C.

As shown in FIG. 7(B), the liquid intake paths q in this embodiment include a first enlarged flow path portion q1 that is directly connected with a flow path s in the tube body 116 and has a greater cross-sectional area than the flow path s, a second enlarged flow path portion q2 that is connected to the first enlarged flow path portion q1 and has a greater cross-sectional area than the first enlarged flow path portion q1, and branch flow path portions q3 that are connected to the second enlarged flow path portion q2 and that branches into a plurality of flow paths each connected to the mixing device 122. The foaming liquid pressed out of the container body 112 by a pressure exerted on the container body 112 from the outside passes via the flow path s in the tube body and then through the first enlarged flow path portion q1, the second enlarged flow path portion q2, and the branch flow path portions q3 of the liquid intake paths q in that order, joins the air intake paths p in the vicinities of the upstream portions of the connection openings 122C of the mixing device 122, and passes through the connection openings 122C into the mixing device 122.

The liquid intake paths q in this embodiment are formed by a through-hole provided in the inside plug 120 and gaps provided between the faces of the mixing device 122 and the inside plug 120 facing each other. The first enlarged flow path portion q1 is formed by the through-hole provided in the inside plug 20, and the second enlarged flow path portion q2 and the branch flow path portions q3 are formed by the gaps provided between the faces of the mixing device 122 and the inside plug 120, which face each other. The outside diameter of the mixing device 122 is equal to or a little greater than the inside diameter of the inside plug 120 at corresponding positions. The second enlarged flow path portion q2 and the branch flow path portions q3 can be formed easily and precisely just by fitting the mixing device 122 into the inside plug 120.

If the cross-sectional area of the liquid intake paths q is smaller than the cross-sectional area of the flow path s in the tube body, the liquid is delivered into the mixing device 122 at so high a flow speed that the foaming liquid and air could be discharged without being mixed sufficiently, preventing foam of good quality from being obtained. In the liquid intake paths q in this embodiment, the first enlarged flow path portion q1 and the second enlarged flow path portion q2 both have greater cross-sectional areas than the flow path s in the tube body. Since the flow speed of the liquid delivered into the mixing device 122 is reduced, the foaming liquid and air are mixed sufficiently in the mixing device 122, and foam of good quality can be obtained.

In the liquid intake paths q in this embodiment, the branch flow path portions q3 branching into the plurality of flow paths are provided downstream of the second enlarged flow path portion q2. In comparison with the foaming liquid delivered to the mixing device through a single flow path portion, the area of contact between the foaming liquid and air increases because of the branch flow path portions q3, so that the foam quality can be homogenized. The branch flow path portions q3 in this embodiment are configured such that the total cross-sectional area of the plurality of branch flow path portions q3 is greater than the cross-sectional area of the flow path s in the tube body. Therefore, the speed of the foaming liquid delivered into the mixing device 122 is reduced, and the foaming liquid and air can be mixed sufficiently, and consequently foam of good quality can be obtained. In the branch flow path portions q3 in this embodiment, the cross-sectional area of a single path of the branch flow path portions q3 is smaller than the cross-sectional area of the flow path s in the tube body. If the cross-sectional area of a single path of the branch flow path portions q3 is larger than the cross-sectional area of the flow path s in the tube body, the amount of foaming liquid flowing into each path of the branch flow path portions q3 varies, making the volume and speed of the foaming liquid delivered from each path of the branch flow path portions q3 to the mixing device 122 uneven and causing the foaming liquid and air to be unevenly mixed, consequently making it impossible to discharge foam of good quality in a stable manner.

The liquid intake paths q in this embodiment are configured such that the cross-sectional area of the second enlarged flow path portion q2 becomes larger than the total cross-sectional area of the plurality of branch flow path portions q3. This prevents the flow speed of the foaming liquid in the second enlarged flow path portion q2 toward the branch flow path portions q3 from exceeding the flow speed in the branch flow path portions q3. Therefore, even if the volume and speed of the flow of the foaming liquid are changed by changing the cross-sectional area of the flow path in the tube body, the effect caused by the flow speed change can be reduced, and the flow of the foaming liquid in the branch flow path portions q3 can be equalized, so that foam of good quality can be obtained. It is preferable that the cross-sectional area of the second enlarged flow path portion q2 be adjusted to be 1.5 times or more and 3 times or less the total cross-sectional area of the branch flow path portions q3.

In the foam dispensing container in this embodiment, the flow path s in the tube body 116 has a cross-sectional area of about 3 $mm^2$; the first enlarged flow path portion q1 has a cross-sectional area of about 5 $mm^2$; the second enlarged flow path portion q2 has a cross-sectional area of about 12.5 $mm^2$; a single flow path of the six flow paths forming the branch flow path portions q3 has a cross-sectional area of about 1 $mm^2$; and the total cross-sectional area of the six flow paths is about 6 $mm^2$.

Figure 8:
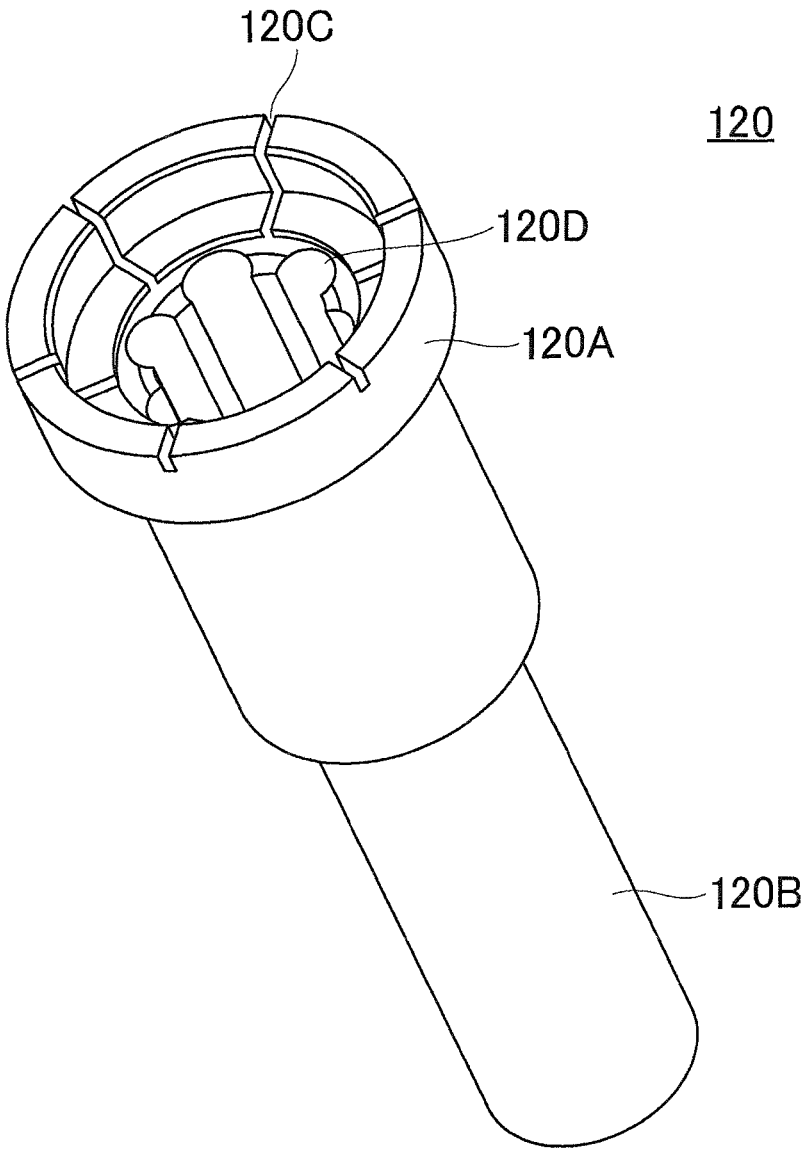
FIG. 8 is a perspective view of an inside plug according to the second embodiment (and the third embodiment) of the present invention.

FIG. 8 is a perspective view of the inside plug 120 in this embodiment.

The inside plug 120 includes the upper tubular portion 120A, which has a concave two-stage tubular shape having different inside diameters, and the lower tubular portion 120B, which has a further smaller diameter. The mixing device 122, which is not shown in this figure, is fitted into the upper tubular portion 120A from above, leaving the gaps between them, and the tube body 116, which is not shown in this figure, is fitted into the lower tubular portion 120B from below.

As shown in FIG. 8, six grooves 120D with a semicircular cross-sectional shape having a specified width and a specified depth are formed in the inner wall of the upper tubular portion 120A of the inside plug 120 from a middle-stage portion to the upper edge of the lower tubular portion 120B at regular intervals in the circumferential direction of the cylindrical cross-section. In this embodiment, the grooves 120D become gaps forming the liquid intake paths q, between the inner wall of the lower tubular portion 120B of the inside plug 120 and the outer wall of the lower tubular portion 122B of the mixing device 122.

Six notch grooves 120C having a specified width and a specified depth are formed in the inner wall of the upper tubular portion 120A of the inside plug 120 from the top edge to the middle-stage portion at regular intervals in the circumferential direction of the cylindrical cross-section. In this embodiment, when the mixing device 122 is fitted into the inside plug 120, the grooves 120C become gaps forming the air intake paths p between the inner wall of the upper tubular portion 120A of the inside plug 120 and the outer wall of the upper tubular portion 122A of the mixing device 122.

In this embodiment, the six air intake paths p and the six liquid intake paths q having the specified widths and depths are formed by the grooves 120C and the grooves 120D. Since the amounts of air and the foaming liquid delivered into the mixing device can be adjusted by adjusting the size and number of grooves 120C and grooves 120D, an appropriate size and number of grooves need to be specified appropriately in accordance with the properties of the foaming liquid and the desired foam quality.

In this embodiment, the liquid intake paths q are formed by providing the grooves 120D in the inner wall of the upper tubular portion of the inside plug 120. The liquid intake paths q may also be formed by providing similar grooves in the outer wall of the lower tubular portion 122B of the mixing device 122, which faces the inner wall of the upper tubular portion 120A. In this embodiment, the air intake paths p are formed by providing the grooves 120C in the inner wall of the upper tubular portion 120A of the inside plug 120. The air intake paths p may also be formed by providing similar grooves in the outer wall of the upper tubular portion 122A of the mixing device 122, which faces the inner wall of the upper tubular portion 120A.

Third Embodiment

The general structure of a lid body 214 of a foam dispensing container 210 according to a third embodiment of the present invention is the same as that of the lid body 114 in the second embodiment shown in FIG. 6.

Figure 9:
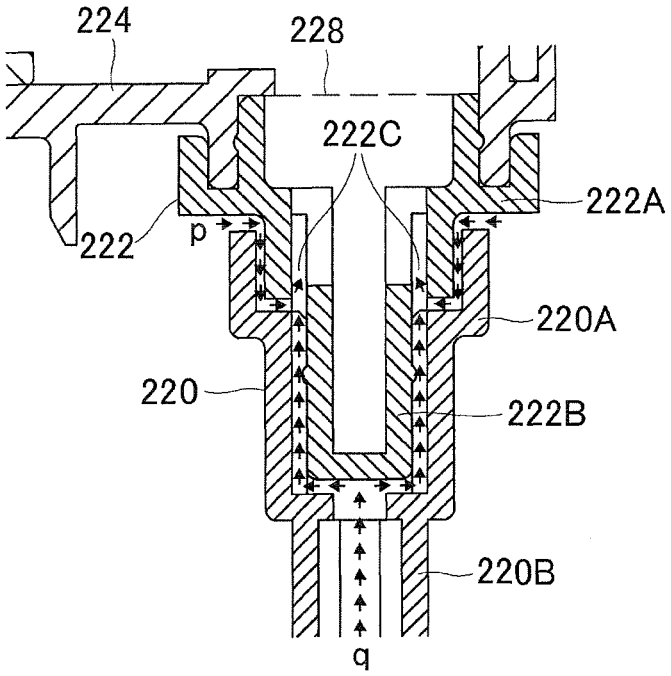
FIG. 9 shows enlarged principal cross-sectional views of the lid body of the foam dispensing container according to the third embodiment of the present invention.
Figure 9:
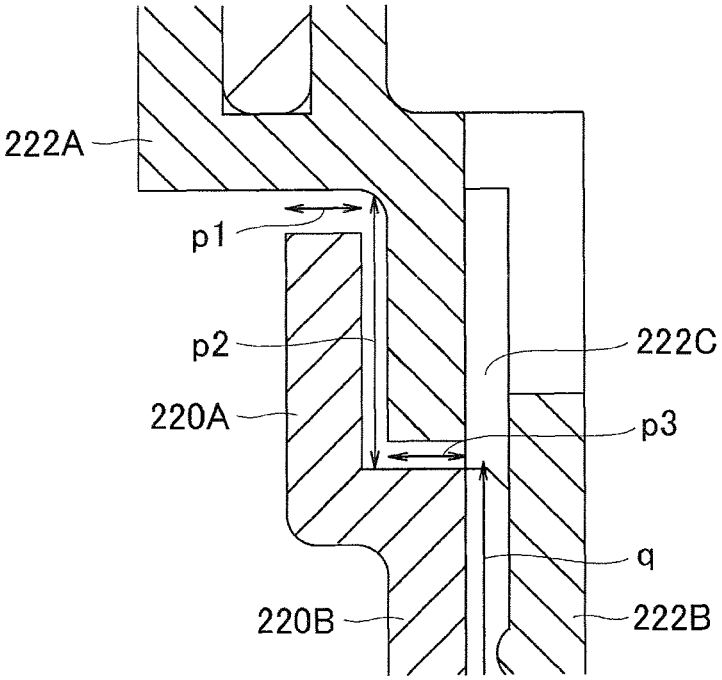

The liquid intake paths and the air intake paths in this embodiment will be described in detail with reference to enlarged principal cross-sectional views of the lid body 214 shown in FIG. 9.

As shown in FIG. 9(A), liquid intake paths q for delivering the foaming liquid from a container body 212 to a mixing device 222 and air intake paths p for delivering air from the upper space in the container body 212 into the mixing device 222 are formed in gaps between the mixing device 222 and an inside plug 220 in the lid body 214 in this embodiment. The liquid intake paths q and the air intake paths p join in vicinities of the upstream portions of connection openings 222C of the mixing device 222, and the two types of paths are connected to the mixing device 222 through the same connection openings 222C.

As shown in FIG. 9(B), the air intake paths p in this embodiment include an upstream horizontal flow path portion p1 that is connected directly to the upper space in the container body 212 and is formed horizontally with the container held in its upright position, a vertical flow path portion p2 that is connected to the upstream horizontal flow path portion p1 and is formed vertically, and a downstream horizontal flow path portion p3 that is connected to the vertical flow path portion p2 and is formed horizontally. When the container body 212 is pressed from the outside, air pushed out of the upper space in the container body 212 passes via the upper horizontal flow path portion p1, the vertical flow path portion p2, and the downstream horizontal flow path portion p3 of the air intake paths p in that order, joins the liquid intake paths q in the vicinities of the upstream portions of the connection openings 222C of the mixing device 222, and is delivered into the mixing device 222 through the connection openings 222C.

The air intake paths p in this embodiment are formed by gaps generated between the surfaces of the mixing device 222 and the inside plug 220, both constituting the lid body 214, when the mixing device 222 and the inside plug 220 are fitted together almost vertically. Since the outer surface of the mixing device 222 is in contact with the inner surface of the inside plug 220, the outside diameter of the mixing device 222 is equal to or a little greater than the inside diameter of the inside plug 220 at corresponding positions. Therefore, the air intake paths p can be formed easily and precisely just by inserting the mixing device 222 into the inside plug 220. The tolerance of the outside diameter of the mixing device 222 is generally +0.1 mm, or preferably +0.05 mm, with respect to the inside diameter of the inside plug, depending on the properties of the material used.

If the mixing device 222 is not fitted into the inside plug 220 sufficiently or if the fitting status between the mixing device 222 and the inside plug 220 is affected by an impact from the outside or the like, for example, the cross-sectional areas of the flow paths would change in the flow path portions perpendicular to the direction in which the mixing device 222 is fitted into the inside plug 220 (horizontal direction), that is, in the upstream horizontal flow path portion p1 and the downstream horizontal flow path portion p3. Since the vertical flow path portion p2 extends in the same direction (vertical direction) as the direction in which the mixing device 222 is fitted into the inside plug 220, the cross-sectional area hardly changes and is kept almost constant irrespective of any change in the fitting status between the mixing device 222 and the inside plug 220.

Therefore, the air intake paths p in this embodiment are configured such that the cross-sectional area of the vertical flow path portion p2 formed in the direction (vertical direction) in which the mixing device 222 is fitted into the inside plug 220 is minimized in comparison with the cross-sectional areas of the flow path portions (upstream horizontal flow path portion p1 and downstream horizontal flow path portion p3) in the other direction.

In this embodiment, a single flow path of six flow paths forming the vertical flow path portion p2 has a cross-sectional area of 0.06 $mm^2$, whereas a single flow path of six flow paths farming the upstream horizontal flow path portion p1 has a cross-sectional area of 0.29 $mm^2$, and a single flow path of three flow paths forming the downstream horizontal flow path portion p3 has a cross-sectional area of 0.09 $mm^2$. Therefore, the cross-sectional area Sp2 of the vertical flow path portion is 0.36 $mm^2$, whereas the cross-sectional area Sp1 of the upstream horizontal flow path portion is 1.74 $mm^2$, and the cross-sectional area Sp3 of the downstream horizontal flow path portion is 0.54 $mm^2$.

In this embodiment, the cross-sectional area of the vertical flow path portion p2 extending in the same direction as the direction in which the mixing device 222 is fitted into the inside plug 220 is minimized, and this vertical flow path portion p2 forms a bottleneck to the amount of air flow when air is delivered from the upper space in the container body 12, via the air intake paths p, into the mixing device 222. When a prescribed pressure is applied to the container body 212 from the outside, the amount of air delivered into the mixing device 222 is determined in accordance with the cross-sectional area of the vertical flow path portion p2. Even if the fitting status between the mixing device 222 and the inside plug 220 changes, the cross-sectional area of the vertical flow path portion p2 hardly changes because the vertical flow path portion p2 extends in the same direction as the direction in which the mixing device 222 is fitted into the inside plug 220, the volume of air delivered into the mixing device 222 can be maintained constant, and foam of stable quality can be provided always.

If the cross-sectional area of the vertical flow path portion p2 is greater than the cross-sectional area of a flow path portion in a different direction (upstream horizontal flow path portion p1 or downstream horizontal flow path portion p3), for example, when the fitting status between the mixing device 222 and the inside plug 220, which are fitted together vertically, changes, and the cross-sectional area of the horizontal flow path portion p1 or p3 changes, the cross-sectional area of the horizontal flow path portion p1 or p3 becomes a bottleneck to the volume of air intake. Since the volume of air to be delivered into the mixing device 222 changes in accordance with the fitting status between the mixing device 222 and the inside plug 220, foam of stable quality cannot be provided.

In the foam dispensing container according to the present invention, the cross-sectional area of the flow path portion (vertical flow path portion p2 in this embodiment) extending in the same direction as the fitting direction is factory-adjusted to deliver an air flow volume that allows foam of desired quality to be obtained.

Although the vertical flow path portion p2 extending in the vertical direction and the upstream horizontal flow path portion p1 and the downstream horizontal flow path portion p3 extending in the horizontal direction are formed in this embodiment, the directions of the flow path portions in the foam dispensing container according to the present invention need not always be vertical or horizontal. For example, a diagonal flow path portion may be formed at a prescribed angle. Even if a flow path portion is formed in a diagonal direction, when the cross-sectional areas of flow path portions are adjusted appropriately in accordance with the fitting direction of the members forming the flow path portions, the same effects as obtained in this embodiment can be obtained. Alternatively, the flow path portion (vertical flow path portion p2 in this embodiment) extending in the same direction as the fitting direction may be connected directly to the upper space in the container body 212, for example.

When Sp2 is the cross-sectional area of the vertical flow path portion p2 and Sp3 is the cross-sectional area of the downstream horizontal flow path portion p3 in the foam dispensing container in this embodiment, it is preferable that the value of the area ratio Sp2/Sp3 be 0.6 or more and less than 1.0. In the present invention, the cross-sectional area of the vertical flow path portion p2 is smaller than the cross-sectional areas of the flow path portions in the other direction, so that the value of the area ratio Sp2/Sp3 will not exceed 1.0. When the value of the area ratio Sp2/Sp3 is smaller than 0.6, insufficient fitting between the inside plug 220 and the mixing device 222 would cause the downstream horizontal flow path portion p3 to have an excessively large cross-sectional area, bringing the flow speed of incoming air from the vertical flow path portion p2 to an excessively low level. This could make it impossible to mix the foaming liquid and air sufficiently in the mixing device 222 and to provide foam of desired quality. A more preferable value of the cross-sectional area ratio Sp2/Sp3 of the flow paths would be 0.8 or more and less than 1.0.

The general structure of the inside plug 220 in the third embodiment of the present invention is the same as that in the second embodiment shown in FIG. 8, and thus, the following explanation will be made with reference to FIG. 8.

The inside plug 220 includes an upper tubular portion 220A having a concave two-stage tubular shape having different inside diameters and a lower tubular portion 220B having a further smaller diameter. The mixing device 222, which is not shown in the figure, is fitted into the upper tubular portion 220A from above, leaving specified gaps between them, and a tube body 216, which is not shown in the figure, is fitted into the lower tubular portion 220B from below.

As shown in FIG. 8, six notch grooves 220C having a specified width and a specified depth are formed in the inner wall of the upper tubular portion 220A of the inside plug 220 from the upper edge to the step portion in the middle at regular intervals radially in the cylindrical cross-section. In this embodiment, when the mixing device 222 is fitted into the inside plug 220, the grooves 220C become gaps forming air intake paths p1 to p3 between the inner wall of the upper tubular portion 220A of the inside plug 220 and the outer wall of the upper tubular portion 222A of the mixing device 222.

Six grooves 220D with a semicircular cross-sectional shape having a specified width and a specified depth are formed in the inner wall of the upper tubular portion 220A of the inside plug 220 from a middle stage portion to the upper edge of the lower tubular portion 220B at regular intervals in the circumferential direction of the cylindrical cross-section. In this embodiment, the grooves 220D generate gaps forming the liquid intake paths q, between the inner wall of the lower tubular portion 220B of the inside plug 220 and the outer wall of the lower tubular portion 2228 of the mixing device 222.

In this embodiment, the six air intake paths p and the six liquid intake paths q having the specified widths and depths are formed by the grooves 220C and the grooves 220D. Since the amounts of air and foaming liquid delivered into the mixing device can be adjusted by adjusting the size and number of grooves 220C and grooves 220D, an appropriate size and number of grooves need to be specified appropriately in accordance with the properties of the foaming liquid and the desired foam quality.

In this embodiment, the air intake paths p are formed by providing the grooves 220C in the inner wall of the upper tubular portion 220A of the inside plug 220. The air intake paths p may also be formed by providing similar grooves in the outer wall of the upper tubular portion 222A of the mixing device 222, which faces the inner wall of the upper tubular portion 220A. In this embodiment, the liquid intake paths q are formed by providing the grooves 220D in the inner wall of the upper tubular portion of the inside plug 220. The liquid intake paths q may also be formed by providing similar grooves in the outer wall of the lower tubular portion 222B of the mixing device 222, which faces the inner wall of the upper tubular portion 220A.

What is claimed is:

1. A foam dispensing container including a container body made of a material possessing elasticity, a lid body mounted to a mouth of the container body, and a tube body connecting an inside of a trunk portion of the container body and an inside of the lid body, and when the container body is pressed from the outside, a foaming liquid contained in the trunk portion of the container body and air in an upper space in the container body are mixed to produce foam in an air-liquid mixing chamber provided in the lid body, and the foam is discharged from an opening of the lid body, wherein the lid body includes;

a plurality of liquid intake paths that are connected through the tube body to the inside of the trunk portion of the container body and deliver the foaming liquid into the air-liquid mixing chamber, a plurality of air intake paths that are connected to the upper space in the container body and deliver air into the air-liquid mixing chamber, an outside-air intake that closes to seal the container body when the container body is pressed and opens to connect the inside of the container body to the outside and to allow air to enter from the outside when the pressure of the container body is reduced, the air-liquid mixing chamber having a closed-bottom tubular shape, which is connected to the plurality of liquid intake paths and the plurality of air intake paths and in which the foaming liquid and air are mixed to produce foam, a foam discharge passage connected to the downstream side of the air-liquid mixing chamber, and a foam discharge opening that is provided at the downstream end of the foam discharge passage and that discharges foam to the outside.

2. The foam dispensing container according to claim 1, wherein the plurality of liquid intake paths and the plurality of air intake paths join in a plurality of air-liquid confluence portions, and the plurality of air-liquid confluence portions are connected to the air-liquid mixing chamber through a plurality of air-liquid connection openings.

3. The foam dispensing container according to claim 2, wherein the lid body includes an inside plug connected to the tube body and a mixing device fitted into the inside plug, the plurality of air intake paths, the plurality of liquid intake paths, and the plurality of air-liquid confluence portions are formed between the inside plug and the mixing device, and the plurality of air-liquid connection openings are formed in the mixing device.

4. The foam dispensing container according to claim 3, wherein the air intake paths are formed by grooves provided in the inner wall of the inside plug.

5. The foam dispensing container according to claim 3, wherein the liquid intake paths are formed by grooves provided in the inner wall of the inside plug.

6. The foam dispensing container according to claim 3, wherein the tube body is fitted into an end of the inside plug.

7. The foam dispensing container according to claim 1, wherein the lid body includes at least an enlarged flow path portion that is connected to the tube body and has a greater cross-sectional area than the tube body, and the enlarged flow path portion is connected to the plurality of the liquid intake paths, and wherein the cross-sectional area of a single flow path in the plurality of the liquid intake paths is smaller than the cross-sectional area of the flow path in the tube body, and the total cross-sectional area of the plurality of flow paths in the plurality of the liquid intake paths is greater than the cross-sectional area of the flow path in the tube body.

8. The foam dispensing container according to claim 7, wherein the cross-sectional area of at least a part of the enlarged flow path portion is greater than the total cross-sectional area of the plurality of flow paths in the plurality of the liquid intake paths.

9. The foam dispensing container according to claim 8, wherein the cross-sectional area of at least a part of the enlarged flow path portion 1.5 times or more and 3 times or less the total cross-sectional area of the plurality of flow paths in the plurality of the liquid intake paths.

10. The foam dispensing container according to claim 7, wherein the plurality of air intake paths and the plurality of liquid intake paths are disposed alternately at regular intervals in the circumferential direction of the air-liquid mixing chamber.

11. The foam dispensing container according to claim 1, wherein the air intake paths are formed by gaps left among a plurality of members forming the lid body when the members are fitted together and include at least a flow path portion provided in the direction in which the plurality of members are fitted together, and that the cross-sectional area of the flow path portion in the fitting direction in the air intake paths is smaller than the cross-sectional area of any flow path portion in other directions.

12. The foam dispensing container according to claim 11, wherein the fitting direction of the plurality of members is almost vertical when the container body is held in the upright position and wherein the flow path portion in the fitting direction is a vertical flow path portion provided almost vertically when the container body is held in the upright position.

13. The foam dispensing container according to claim 12, wherein the air intake paths include the vertical flow path portion and a downstream horizontal flow path portion that is connected to the downstream side of the vertical flow path portion and provided almost horizontally when the container body is held in the upright position, and wherein the ratio of the cross-sectional area Sp2 of the vertical flow path portion to the cross-sectional area Sp3 of the downstream horizontal flow path portion satisfy $0.6 \leq Sp2/Sp3 < 1.0$.

* * * * *